US011046099B2

(12) United States Patent
Boyum et al.

(10) Patent No.: US 11,046,099 B2
(45) Date of Patent: Jun. 29, 2021

(54) DOOR ASSEMBLY FOR SERVICEABLE MACHINE

(71) Applicant: Hewlett-Packard Development Company, L.P., Spring, TX (US)

(72) Inventors: Gerald Boyum, Vancouver, WA (US); Michael Kevin Bowen, Vancouver, WA (US); Tod Kinsley, Vancouver, WA (US); Lynn A Collie, Vancouver, WA (US); Kevin Lo, Vancouver, WA (US); Jeremy Daniel Barker, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/332,707

(22) PCT Filed: Sep. 12, 2016

(86) PCT No.: PCT/US2016/051382

§ 371 (c)(1),
(2) Date: Mar. 12, 2019

(87) PCT Pub. No.: WO2018/048455

PCT Pub. Date: Mar. 15, 2018

(65) Prior Publication Data

US 2019/0232694 A1 Aug. 1, 2019

(51) Int. Cl.

| | |
|---|---|
| ***B41J 29/13*** | (2006.01) |
| ***B41J 29/02*** | (2006.01) |
| ***B41J 29/12*** | (2006.01) |
| *B41J 3/36* | (2006.01) |

(52) U.S. Cl.
CPC ..... *B41J 29/13* (2013.01); *B41J 29/02* (2013.01); *B41J 29/12* (2013.01); *B41J 3/36* (2013.01)

(58) Field of Classification Search
CPC ... B41J 29/13; B41J 29/02; B41J 29/12; B41J 3/36
See application file for complete search history.

(56) References Cited

U.S. PATENT DOCUMENTS

| | | | |
|---|---|---|---|
| 7,382,998 | B2 | 6/2008 | Murrell |
| 7,386,252 | B2 | 6/2008 | Portig et al. |
| 7,653,328 | B2 | 1/2010 | Igarashi et al. |

(Continued)

FOREIGN PATENT DOCUMENTS

| | | | |
|---|---|---|---|
| CN | 1084675 | A | 3/1994 |
| CN | 101117876 | A | 2/2008 |

(Continued)

*Primary Examiner* — Henok D Legesse
(74) *Attorney, Agent, or Firm* — HP Inc. Patent Department

(57) ABSTRACT

A serviceable machine includes a door assembly having a door, and a jointed assembly that extends between an external surface of the serviceable machine and the door. The jointed assembly is operable to move the door between a closed position in which an interior region of the serviceable machine is covered, and an open position in which the interior portion of the interior region is unobstructed. The jointed assembly may extend connectivity to the door when the door is in either the open or closed positions. Additionally, the door can mechanically and electrically decouple from the jointed assembly.

16 Claims, 6 Drawing Sheets

(56) References Cited

U.S. PATENT DOCUMENTS

| | | | | |
|---|---|---|---|---|
| 7,684,731 | B2 | 3/2010 | Hirose et al. | |
| 8,513,551 | B2 | 8/2013 | Ohta | |
| 2002/0002758 | A1* | 1/2002 | Stura | E05D 11/0081 16/287 |

FOREIGN PATENT DOCUMENTS

| | | | |
|---|---|---|---|
| CN | 101223122 | B1 | 2/2013 |
| CN | 204357238 | U | 5/2015 |
| CN | 204902392 | U | 12/2015 |
| CN | 205330336 | U | 6/2016 |
| KR | 0120315 | Y1 | 10/1998 |
| KR | 20050076126 | A | 7/2005 |

* cited by examiner

DOOR ASSEMBLY FOR SERVICEABLE MACHINE

BACKGROUND

Some machines, such as high-performance multi-function printers (with copying and scanning functionality), require maintenance from technicians. Typically, the technicians access an interior of the machine to interface with the controller or visually inspect the interior of the machine.

DETAILED DESCRIPTION

Figure 1A:
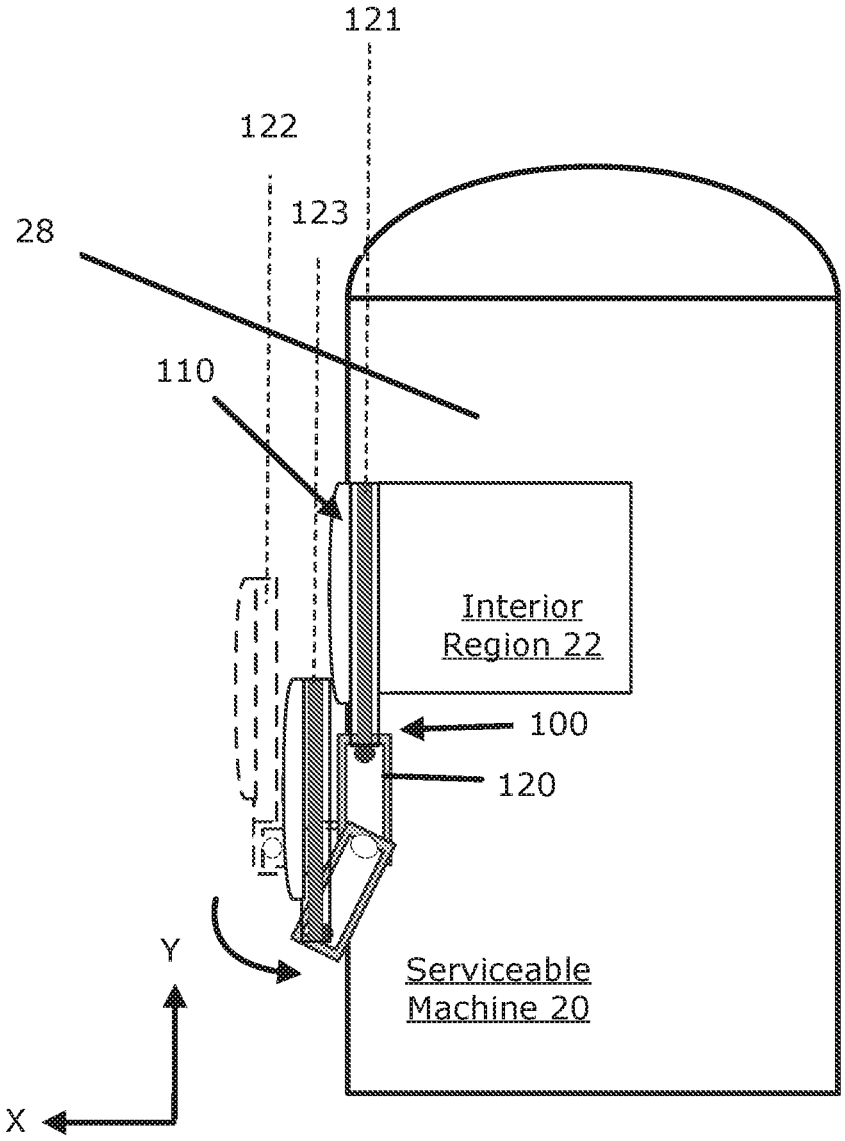
FIG. 1A is a side view of an example door assembly for a serviceable machine 20.

Examples as described provide for a door assembly that can readily attach and detach, both mechanically and electrically, from a serviceable machine to provide easy and prompt access to a serviceable area of the serviceable machine. Among other benefits, an example door assembly as described enables serviceability of serviceable machines and reduces service time, while providing a robust mechanical connection and consistent electrical connection.

According to some examples, a serviceable machine includes a door assembly having a door, and a jointed assembly that extends between an external surface of the serviceable machine and the door. The jointed assembly is operable to move the door between a closed position in which an interior region of the serviceable machine is covered, and an open position in which the interior portion of the interior region is unobstructed. The jointed assembly may extend connectivity to the door when the door is in either the open or closed positions. Additionally, the door can mechanically and electrically decouple from the jointed assembly.

According to an alternative aspect, a door assembly is provided for a serviceable machine. The door assembly may include a door and a jointed assembly as described with other examples.

Still further, in variations, a housing is provided for a serviceable machine. The housing may include an exterior structure, including an external surface on which an internal region of the serviceable machine is accessible. The housing may also include a door assembly having a door, and a jointed assembly. The jointed assembly connects to the external surface and extends to the door. The jointed assembly may be operable to move the door between a closed position in which the interior region of the serviceable machine is covered, and an open position in which the interior portion of the interior region is unobstructed. The jointed assembly may electrical connectivity to the door when the door is in either the open or closed positions. Additionally, the door can mechanically and electrically decouple from the jointed assembly.

FIG. 1A through FIG. 1D illustrate an example door assembly for providing access to an interior of a serviceable machine. According to some examples, a door assembly 100 may include a door 110 and multiple jointed assemblies 120. In some implementations, the door assembly 100 may be an integrated feature of the serviceable machine 20. In variations, the door assembly 100 may be provided as a modularized assembly that can be manufactured separately for the serviceable machine 20. For example, the door assembly can be provided as a retrofit or accessory unit for a serviceable machine. Still further, the door assembly 100 may be provided as part of a housing 28 or housing section of the serviceable machine.

According to some examples, each jointed assembly 120 can extend or otherwise move about at least the X and Y axes, to enable movement of the door 110 as between multiple positions relative to a face 25 of the serviceable machine 20. According to some examples, the door assembly 100 can be manipulated to move the door 110 from an attached position that fully obstructs and confines an interior portion 22 of a serviceable machine 20, to multiple extended positions which provide partial or complete access to the interior portion 22.

Additionally, in some examples, the door 110 can be decoupled and removed from the door assembly 100 to provide greater ease of access to the interior 22 of the serviceable machine 20. Still further, in some examples, the door assembly 100 can maintain an electrical connection to enable operability of switches or electrical features related to the operation of the serviceable machine 20, even when the door 110 is in one of the extended positions.

The serviceable machine 20 may correspond to, for example, machinery that maintains replenishable resources within the interior region 22. By way of example, the serviceable machine 20 may correspond to an office printer, copier, and/or scanner. In other examples, the serviceable machine 20 may correspond to a 3D printer. The interior region 22 of the serviceable machine 20 may maintain replenishable resources, such as toner or ink (e.g., for printer) or filament (e.g., for 3D printer). The interior region 22 of the serviceable machine 20 may also provide access to components which may typically be serviced by users or technicians. For example, the interior region 22 may provide access to a controller (e.g., computerized component) for enabling operation of the serviceable machine 20. Depending on the serviceable machine 20, a technician may perform operations such as refilling resources which are used by the serviceable machine 20, interfacing with ports of a controller, and/or replacing components (e.g., controller) of the door assembly 100. As described with examples, a technician or other user can manipulate the door assembly 100 to obtain access to the interior region 22 of the serviceable machine 20 as needed.

As illustrated by an example of FIG. 1A through FIG. 1D, the door assembly 100 can be manipulated to move the door 110 from a closed position (e.g., door location 121) to an open position (e.g., door location 123). The door location 123 may correspond to a fully open position, where the door assembly 100 remains mechanically connected to the serviceable machine 20, and the interior region 22 is completely unobstructed by the door 110.

Still further, in some examples, the door 110 can be removed from the door assembly 100. For example, the door 110 can be removed from the door assembly 100 only when in the open position, or when the door is in any of the depicted door locations 121-123. Among other benefits, when serviceable machine 20 requires service, a technician or user may swing the door 110 from the closed position to the open position and ultimately remove the door from serviceable machine 20 in order to gain access to the serviceable area. In describing an example of FIG. 1A through FIG. 1D, reference is made to a reference frame defined by axes X, Y, and Z.

FIG. 1A is a side view of the door assembly 100 for serviceable machine 20, showing manipulation of the door 110 between alternative door positions. The jointed assemblies 120 can be structured to enable movement of the door 110 in multiple directions, such as along reference axes X, Y. In one implementation, the door 110 can be manipulated to swing from a closed position (shown by door location 121) to a partially opened position (shown by door location 122), and then to a closed position (shown by door location 123). In variations, the door 110 can translate separately in X and Y directions to be positioned in any of the open, partially opened, or closed positions. For example, the door 110 may be moved linearly in the X direction to move from the closed position (door location 121) to a partially opened position (door location 122). As an addition or variation, the door 110 may be moved linearly in the Y direction move from the partially opened position (door location 122) to the opened position (door location 123). Still further, the jointed assemblies 120 may include hinges or pivot connectors that enable the door 110 to swivel and change orientation when moved between the door locations 121, 122 and/or 123.

In some examples, at least one jointed assemblies 120 is integrated with one or more electrical connectors, such that movement of the door 110 as between door locations 121, 122 and/or 123 maintains a desired electrical connection with respect to a functionality or component of serviceable machine 20. For example, a power switch may be provided with the door 110, which the user can operate to switch the serviceable machine 20 on or off. At least one jointed assembly 120 may be structured to maintain the electrical connectivity provided by the power switch.

In one implementation, the door 110 swings (along X and Y axes) toward serviceable machine 20 and the open position (door location 123). When swung back, an interior panel 102 of the door 110 is oriented inward to face and be substantially aligned with the exterior face 25 of the serviceable machine 20. The interior panel 102 of the door 110 may be abutted against, or otherwise closely located to the exterior face 25 of serviceable machine 20. When the door 110 is positioned at door location 123 in this manner, the interior region 22 of the serviceable machine 20 is fully accessible, while the door 110 is at least mechanically connected to the serviceable machine 20. In some variations, one or more components provided with the door 110 may also maintain electrical connectivity with respect to the serviceable machine 20.

To gain even greater access to the interior region 22 of the serviceable machine 20, door 110 can be removed completely from a remainder of the door assembly 100. In one implementation, the door assembly 100 includes a locking mechanism 230 (see FIG. 2A and FIG. 2B) to enable the door 110 to be mechanically locked and unlocked with respect to a remainder of the door assembly 100. When in the closed position (door location) 123, for example, the locking mechanism 230 (see FIG. 2A and FIG. 2B) can be manipulated (e.g., manually) to an unlocked position such that the door 110 can be detached from the door assembly 100. Once removed, the door 110 is mechanically and electronically disconnected from serviceable machine 20.

Figure 1B:
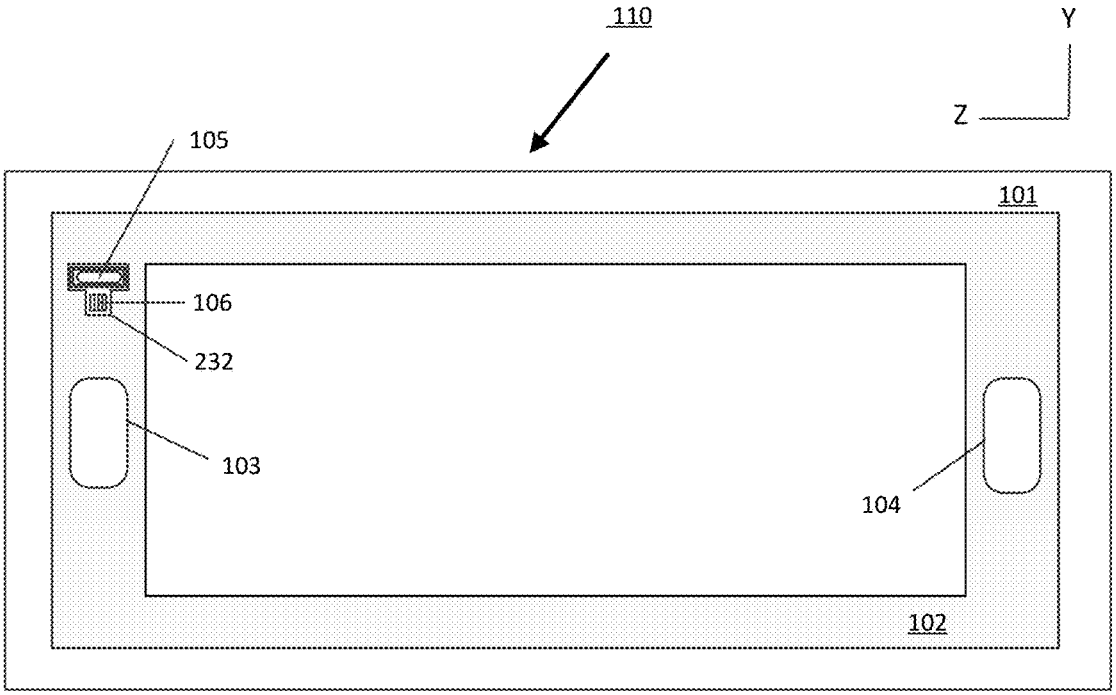
FIG. 1B illustrates an interior of a door for an example door assembly of FIG. 1A.

FIG. 1B illustrates an interior of the door for an example door assembly of FIG. 1A. According to some examples, the interior panel 102 of the door 110 includes a shell 101 and frame 112. Each of the shell 101 and frame 112 may be formed from, for example, plastic, polymer composite and/or metal. In one implementation, the shell 101 is formed from plastic, while the frame 112 is formed from metal or other that can stiffen the exterior shell 101. The process of opening and closing the door 110 may require the technician or user to manually engage exterior plastic shell 101 to either pull the door open or push the door closed. The stiffening of exterior plastic shell 101 by interior frame 112 improves the mechanical integrity of exterior plastic shell 101.

The interior panel 102 may include multiple cutouts, including openings 103 and 104, located on opposite side of interior frame 112. Each of the openings 103, 104 receives and retains a corresponding jointed assembly 120, so as to couple the door 110 to the serviceable machine 20. As described in greater detail, the openings 103, 104 can be coupled with a corresponding locking mechanism 230 (see FIG. 2A and FIG. 2B), to receive and retain an end of a corresponding jointed assembly 120 in a locked orientation. The locking mechanism can also be manipulated about a respective one of the openings 103, 104 into an unlocked position, to enable detachment of the door 110 from the corresponding jointed assembly. While an example of FIG. 1B illustrates two openings 103, 104, other examples may provide for more or fewer cutouts and/or jointed assemblies.

According to some examples, the interior panel 102 also includes a power feature 105 (e.g., mechanical button, touch-sensitive surface, etc.) or other electrical component or set of components. The power feature 105 can be electrically connected to a connector 106 (e.g., printed circuit board with electrical leads), such that the connector 106 is able to electronically connect with the power feature 105. The power feature 105 provides an example of a command interface to the controller of the serviceable machine 20. For example, a user may press the power feature 105 in order to cause the controller of the serviceable machine to receive a power-down or shut-off command. Among other benefits, the placement of the power feature 105 (or other electrical function) on the door 110 enables a technician or user to power down the serviceable machine 20 when the door 110 is in either the closed or opened positions. In this way, a technician or user can, for example, visually inspect the interior region 22 of the serviceable machine 20 before making a determination to power the machine off, without having to move the door 110 from the open position to the closed position. In variations, other electrical components (e.g., control panel) can be electrically connected and provided on the door 110 for use by a technician or user when the door 110 is in either of the open or closed positions.

Figure 1C:
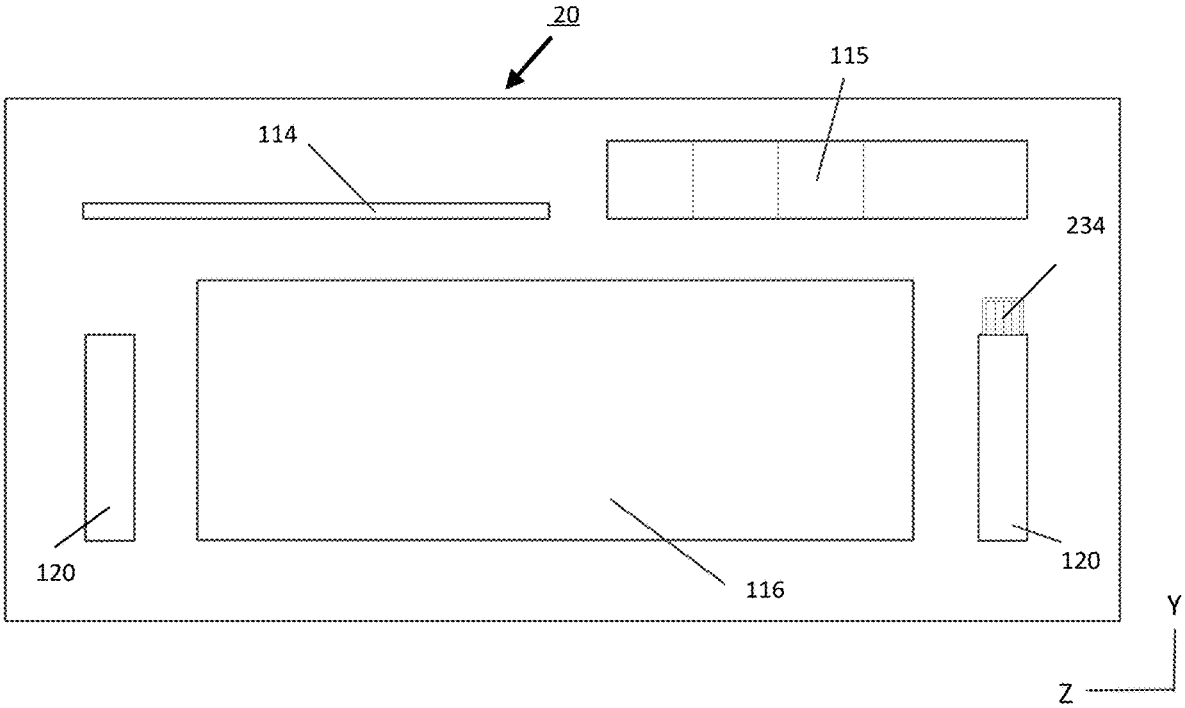
FIG. 1C illustrates an example portion of a serviceable machine, for use with a door assembly such as shown by an example of FIG. 1A.

FIG. 1C illustrates a portion of a serviceable machine, for use with a door assembly such as shown by an example of FIG. 1A. In an example shown, the jointed assemblies 120 extend from a housing 28 of the exterior face 25 of the serviceable machine 20. The housing 28 may be concealed by the door 110 when the door is in the closed position. By way of example, the housing 28 may include a cartridge area 115, an illumination area 114, and a mechanical area 116.

The jointed assemblies 120 may extend from, for example, a perimeter of the housing 28. As described with examples of FIG. 2A through FIG. 2C, each jointed assembly 120 may be implemented as a four-bar style hinge mechanism, with one end section fastened to the exterior face of the serviceable machine 20, and another end section (now shown) fastened to the interior panel 102 of the door 110. When a technician or user completely removes door 110, door 110 detaches from jointed assemblies 120, but the jointed assemblies 120 remain attached to serviceable machine 20 via the fastened end section 112.

In addition to the mechanical connection between door 110 and serviceable machine 20, jointed assembly 120 may also extend electrical connectivity (e.g., through internal wiring) from the serviceable machine 20 to the door 110. As discussed with other examples, the door assembly 100 can be operated to move the door 110 from the closed position to the open position, while maintaining electrical connectivity via the jointed assembly 120. Like the mechanical connection, the electrical connection disconnects when a technician or user removes the door.

Figure 1D:
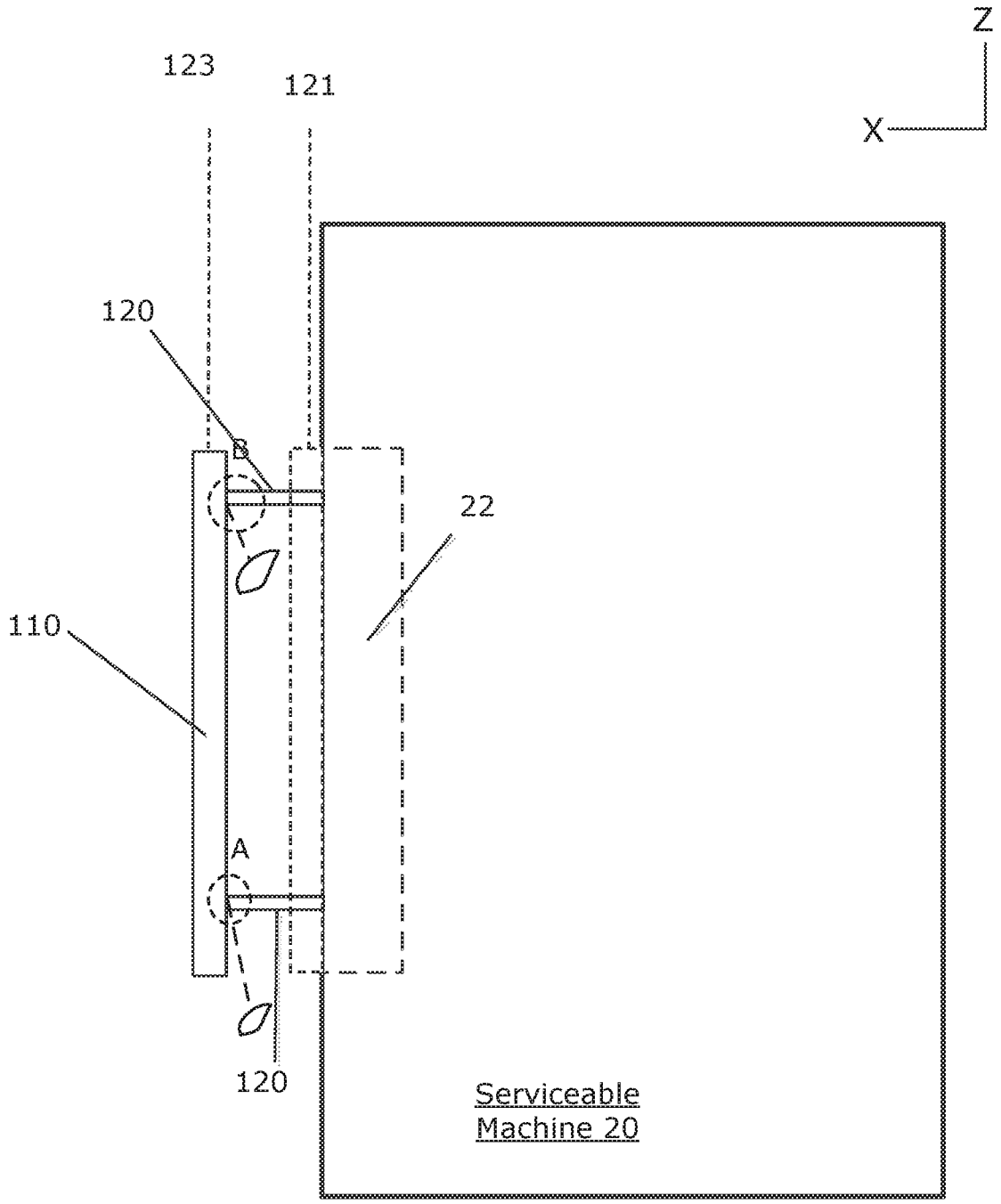
FIG. 1D is a top view of an example door assembly of FIG. 1A.

FIG. 1D is a top view of an example door assembly such as shown by FIG. 1A. As shown, the door assembly 100 provides for the door 110 to be moved as between a closed position (shown by door location 121) and an open position (shown by door location 123). In the closed position, the interior region 22 of the serviceable machine is occluded, while in the open position, the interior region 22 is completely unobstructed by the door 110. The distance D between the door 110 and the serviceable machine 20 may vary, based on implementation. For example, the door 110 may abut the exterior face 25 of the serviceable machine 20 in the closed position, or there may alternatively be provided a gap or separation distance.

In an example shown, at least two jointed assemblies 120 may mechanically connect the door 110 with the serviceable machine 20. As described with an example of FIG. 2A and FIG. 2B (showing a close-up of region A), one or both jointed assemblies 120 may be provided a locking mechanism to mechanically couple and decouple with the door 110. As described with an example of FIG. 2C (showing a close-up of region B), at least one of the jointed assemblies 120 provides electrical connectivity to the door 110 when the door is in either of the open or closed positions.

Figure 2A:
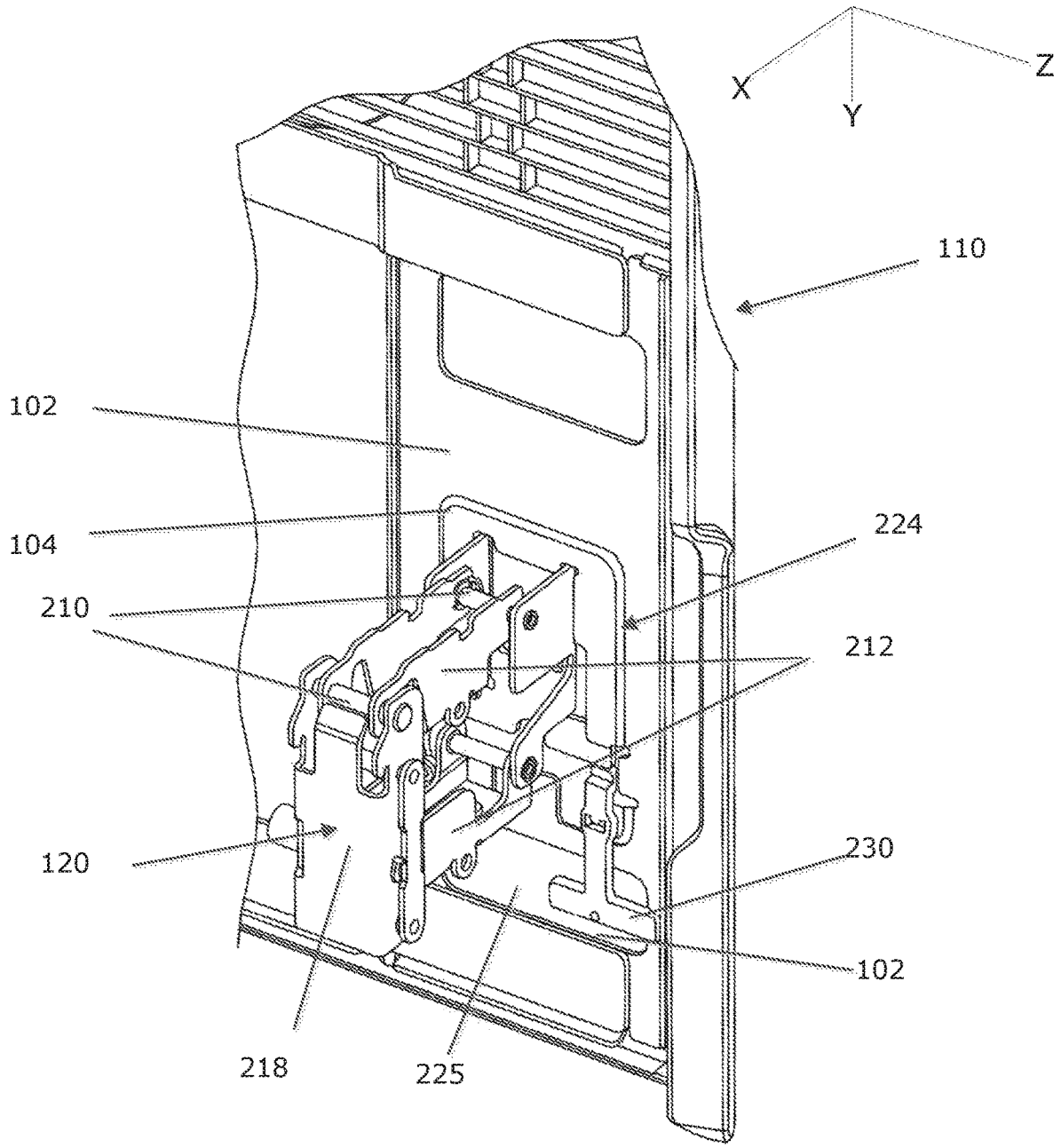
FIG. 2A is an isometric and close-up view of a region A of FIG. 1D when in a locked state.

FIG. 2A is an isometric and close-up view of a region A of FIG. 1D, illustrating a juncture between the door 110 and one of the jointed assemblies 120 of an example door assembly 100. As shown, the jointed assembly 120 extends from the serviceable machine 20 (not shown in FIG. 2A) to the interior panel 102 of the door 110. The jointed assembly 120 includes a machine-side interface 218 to connect to serviceable machine 20. Additionally, the jointed assembly 120 includes multiple members 210 and joints 212 to enable the door 110 to swing and/or translate. For example, the members 210 can be moved about the joints 212, to enable the door 110 and/or translate along the X and Y axes. In one implementation, the jointed assembly 210 includes multiple bars that collectively extend outward (e.g., along X) to the interior of the door 110, to enable the swinging motion of door 110 (e.g., in X and y).

In FIG. 2A, the jointed assembly 120 includes a door interface end 224 that extends through the opening 104 of the door 110. The door interface end 224 of jointed assembly 120 may mirror a shape of the opening 104, to enable the door interface end 224 to be received and retained within the opening 104. A locking mechanism 230 can extend from the interior panel 102 to block lateral movement (e.g., perpendicular to longitudinal reference) of the door interface end 224 with respect to the opening 104. The locking mechanism 230 may engage with features of the interior panel 102 and/or jointed assembly 120 to bias or lock into a position that blocks movement of the jointed assembly 120 with respect to the opening 104. In one implementation, the locking mechanism 230 (see FIG. 2A and FIG. 2B) blocks lateral movement of the jointed assembly 120 along a direction of the Y reference. In this way, the door interface end 224 is constrained and retained within the opening 104.

According to some examples, the locking mechanism 230 includes a pivot connection to the interior panel 102. In some implementations, the pivot connection of the locking mechanism 230 may also be spring-loaded, so that the locking mechanism is biased to remain in the locked orientation. When in the locked orientation, the jointed assembly 120 may be pressed against the interior panel 102 (via the locking mechanism 230) while the door interface of the jointed assembly 120 partially extends through the opening 104.

Figure 2B:
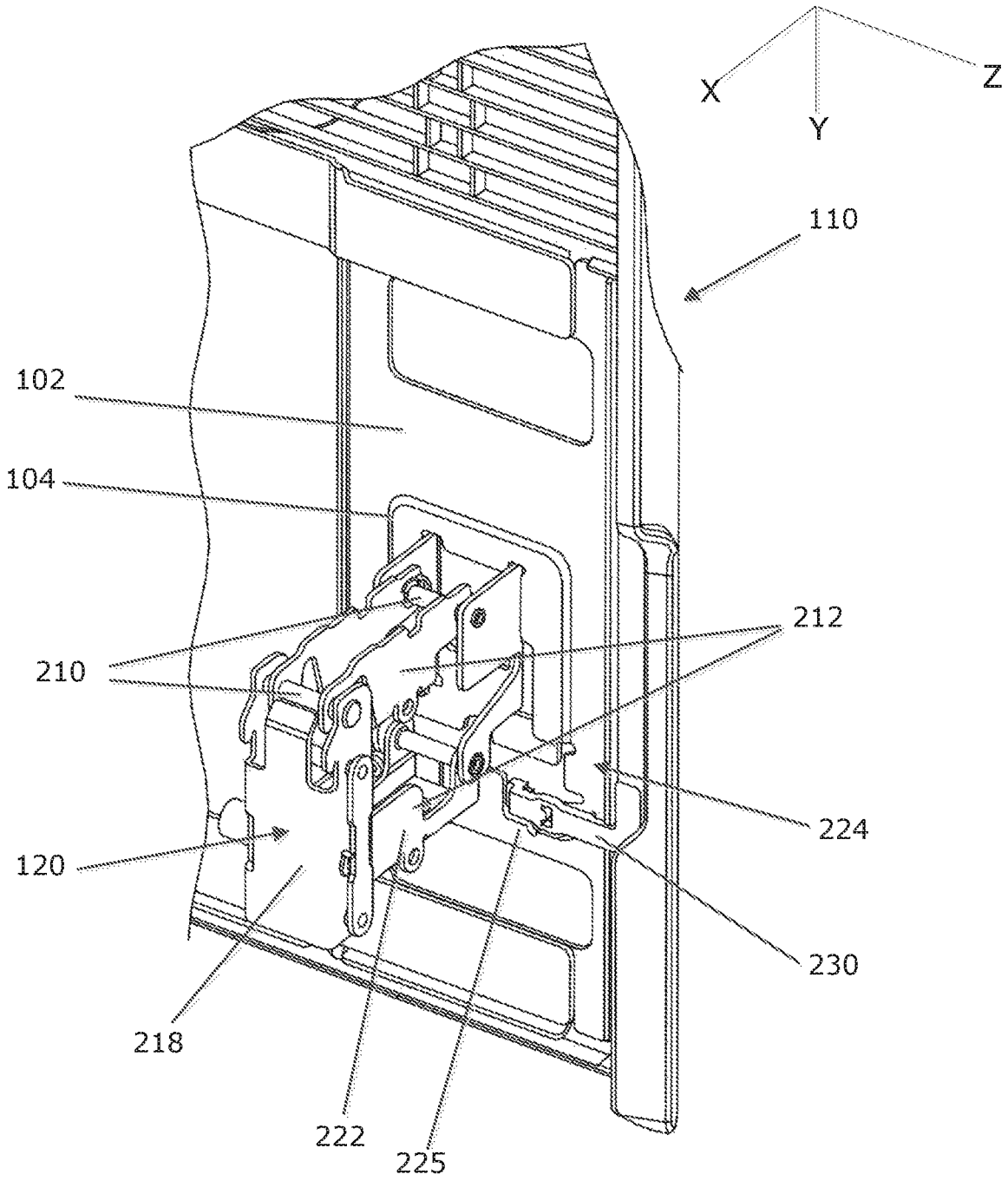
FIG. 2B is an isometric and close-up view of the region A of FIG. 1D when in an unlocked state.

FIG. 2B illustrates the juncture between the door 110 and the jointed assembly 120 in an unlocked state. In one example, the locking mechanism 230 is T-shaped, with a narrow end pinned to the interior surface 225 of the interior panel 102 of the door 110. To transition from the locked state to the unlocked state, the wider end of the locking mechanism 230 is pivoted into a clearing of the interior panel 102, so that it provides no obstruction to the lateral movement of the jointed member.

In variations, the locking mechanism 230 can be pivoted between alternative states of bias and non-bias, corresponding to the locked and unlocked states. In the unlocked state, the locking mechanism 230 can be pivoted into an orientation in which the bias with respect to the interior panel 102 is lost. In one implementation, the interior panel 102 of the door 110 can include a thickness variation that is used to engage the locking mechanism 230 in the locked state. When pivoted, the thickness of the interior panel 102 may provide clearance. The clearance provided by the relative thickness variation can release the bias of the locking mechanism 230, resulting in the jointed assembly 120 becoming loosely engaged with the opening 104.

In use, a technician or other user may manually pivot the locking mechanism 230 90 degrees into the unlocked position. With the locking mechanism 230 in the unlocked position, the door 110 can be detached from the corresponding jointed assembly 120.

According to some examples, two jointed assemblies 120 extend between the door 110 and the serviceable machine 20. Each of the jointed assemblies may connect to the door 110 via one of the corresponding openings 103, 104 using a corresponding locking mechanism 230. In variations, only some (e.g., one of the two jointed assemblies 120) includes the locking mechanism 230, and the engagement of the locking mechanism on one end of the door 110 forcibly retains both jointed assemblies 120 with their respective openings 103, 104 of the door 110.

Figure 2C:
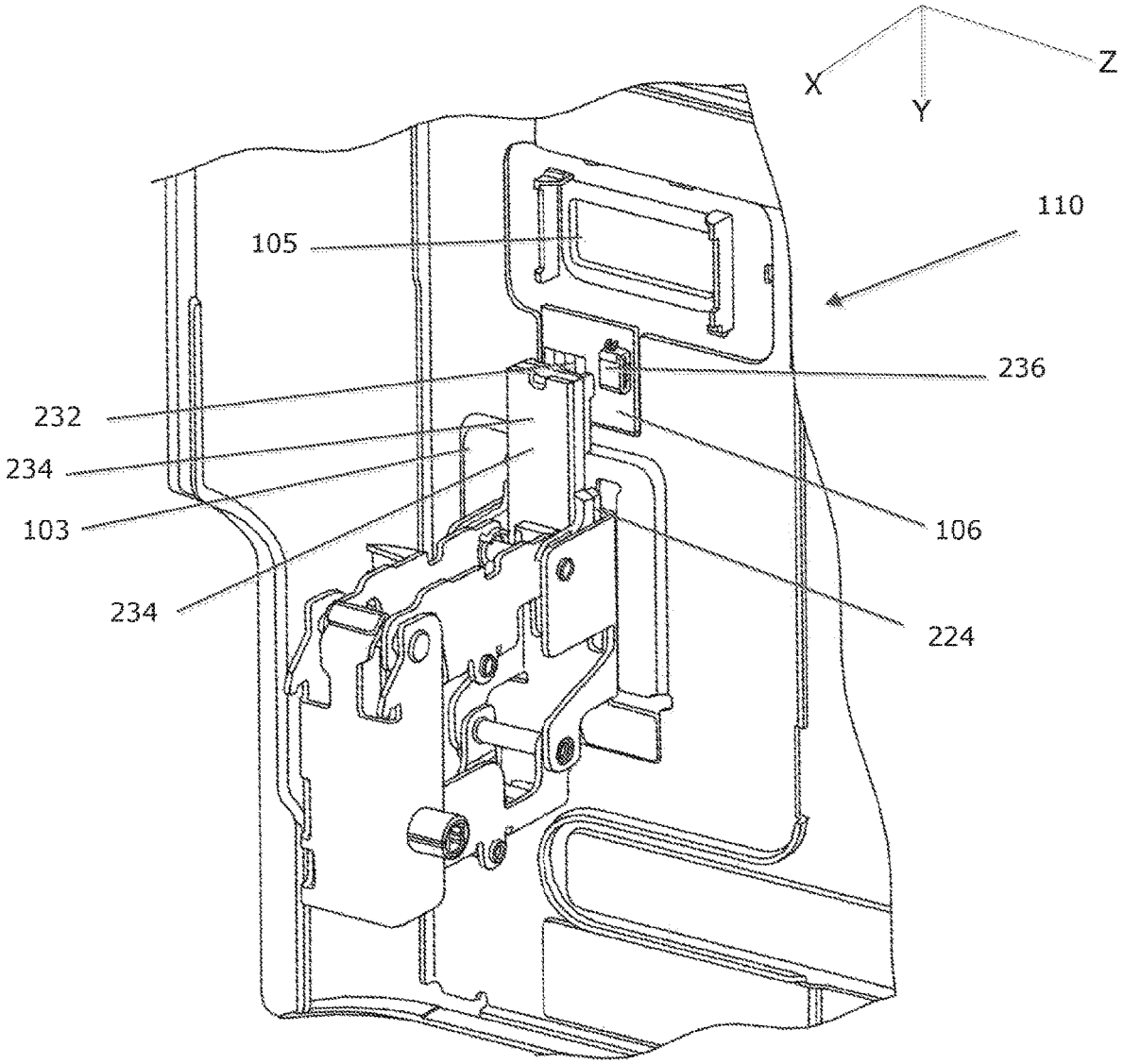
FIG. 2C is an isometric and close-up view of the region B of FIG. 1D.

FIG. 2C is an isometric and close-up view of a region B of FIG. 1D, illustrating another juncture between the door 110 and one of the jointed assemblies 120 of an example door assembly 100. In FIG. 2C, the jointed assembly 120 provides electrical interconnect to the door 110. In one implementation, only one of the jointed assemblies 120 extends electrical connectivity to the door 110. In variations, multiple (or all) jointed segments 120 provide electrical connectivity to the door 110.

As shown by an example of FIG. 2C, the jointed assembly 120 extends partially through the opening 103, where it is retained. In one implementation, the locking mechanism 230 can be assumed occluded and can be implemented in a manner described with an example of FIG. 2A and FIG. 2B.

Accordingly, the jointed assembly 120 can be forcibly retained within the opening when in the locked state.

As described with FIG. 1B, the door 110 may include connector 106 to extend electrical connectivity through the door 110. In one implementation, the connector 106 can include electrical leads 232 and outlet 236. As the electrical interconnected, the jointed assembly 120 may include a contact extension 234 that is aligned over the electrical leads 232 of the connector 106 (provided on the interior panel 102 of the door 110). The contact extension 234 can include, for example, pogo pin or wiper type connector elements on an opposing face (now shown), in alignment with the connector 106. In variations, other types of electrical connectors may be used, including, for example, near-field connectors for exchanging power. In this way, the electrical leads 232 of the interior door are positioned to electrically mate with corresponding connectors of the jointed assembly 120.

In an example of FIG. 2C, when the jointed assembly 120 is in the locked state, the contact extension 234 is pressed against the electrical leads 232 of the connector 106. The electrical connectivity from the serviceable machine 20 is thus extended to the connector 106, and made available through the output connector 236. The output connector 236 may connect to, for example, a switch or electrical lead of the power feature 105. In this way, the jointed assembly 120 may maintain the electrical connection with the leads 232 as the door 110 is moved between the open and closed positions. In this way, a technician or user can, for example, operate the power switch when the door 110 is in either the open or closed positions (or partially-opened positions).

It is contemplated for examples described herein to extend to individual elements and concepts described herein, independently of other concepts, ideas or system, as well as for examples to include combinations of elements recited anywhere in this application. Although examples are described in detail herein with reference to the accompanying drawings, it is to be understood that the concepts are not limited to those precise examples. Accordingly, it is intended that the scope of the concepts be defined by the following claims and their equivalents. Furthermore, it is contemplated that a particular feature described either individually or as part of an example can be combined with other individually described features, or parts of other examples, even if the other features and examples make no mentioned of the particular feature. Thus, the absence of describing combinations should not preclude having rights to such combinations.

What is claimed is:

1. A serviceable machine comprising:

a door assembly including a door, a jointed assembly that extends between an external surface of the serviceable machine and the door, and a locking mechanism to be positioned in a locked state in contact with the jointed assembly to maintain the door in connection with the jointed assembly, and an unlocked state out of contact with the jointed assembly to permit removal of the door from the jointed assembly;

wherein the jointed assembly is operable to move the door between a closed position in which an interior region of the serviceable machine is covered, and an open position in which the interior portion of the interior region is unobstructed;

wherein the jointed assembly extends electrical connectivity to the door when the door is in either the open or closed positions, and a door interface end of the jointed assembly is to partially extend into an opening of the door and remain connected with the door when the locking mechanism is in the locked state and the unlocked state; and wherein the door is to mechanically and electrically decouple from the jointed assembly.

2. The serviceable machine of claim 1, wherein the door assembly is manipulatable to swing the door from the closed position to the open position.

3. The serviceable machine of claim 1, wherein the door assembly extends electrical connectivity to a power feature that is provided on the door to enable an operator to switch a power state of the serviceable machine when the door is in either of the open or closed positions.

4. The serviceable machine of claim 1, wherein the door is to be completely removed from the jointed assembly when decoupled.

5. The serviceable machine of claim 1, wherein the door assembly includes multiple jointed assemblies that extend between the serviceable machine and the door.

6. The serviceable machine of claim 1, wherein the locking mechanism is pinned with respect to at least one end, to an interior surface of the door to preclude movement of the jointed assembly in at least one direction with respect to the door.

7. The serviceable machine of claim 1, wherein the locking mechanism precludes movement of the jointed assembly in at least a direction that is perpendicular to a longitudinal axis of the opening.

8. The serviceable machine of claim 1, wherein the door includes a connector that is positioned to electrically mate with a connector of the jointed assembly when the locking mechanism is in the locked state.

9. The serviceable machine of claim 1, wherein the door covers an interior region when in the closed position, the interior region including at least one of a replenishable resource or a controller.

10. The serviceable machine of claim 1, wherein the serviceable machine is a multi-function office machine that is to perform of at least one of printing or copying.

11. The serviceable machine of claim 1, wherein the serviceable machine is a three-dimensional printer.

12. A door assembly for a serviceable machine, the door assembly comprising:

a door;

a jointed assembly that extends between an external surface of the serviceable machine and the door; and a locking mechanism to be positioned in a locked state in contact with the jointed assembly to maintain the door in connection with the jointed assembly, and an unlocked state out of contact with the jointed assembly to permit removal of the door from the jointed assembly, wherein the jointed assembly is operable to move the door between a closed position in which an interior region of the serviceable machine is covered, and an open position in which the interior portion of the interior region is unobstructed;

wherein the jointed assembly extends electrical connectivity to the door when the door is in either the open or closed positions, and a door interface end of the jointed assembly is to partially extend into an opening of the door and remain connected with the door when the locking mechanism is in the locked and unlocked states; and wherein the door is to mechanically and electrically decouple from the jointed assembly.

13. The door assembly of claim 12, wherein the jointed assembly includes a connector to electrically mate with a connector of the door when the door is in either the open or closed positions.

14. The door assembly of claim 13, wherein the connector of the door is to electrically decouple from the connector of the jointed assembly when the door is mechanically decoupled from the jointed assembly.

15. A housing for a serviceable machine, the housing comprising:

an exterior structure including an external surface on which an internal region of the serviceable machine is accessible;

a door assembly including a door, a jointed assembly that connects to the external surface and extends to the door, and a locking mechanism to be positioned in a locked state in contact with the jointed assembly to maintain the door in connection with the jointed assembly, and an unlocked state out of contact with the jointed assembly to permit removal of the door from the jointed assembly;

wherein the jointed assembly is operable to move the door between a closed position in which the interior region of the serviceable machine is covered, and an open position in which the interior portion of the interior region is unobstructed;

wherein the jointed assembly extends electrical connectivity to the door when the door is in either the open or closed positions, and a door interface end of the jointed assembly is to partially extend into an opening of the door and remain connected with the door when the locking mechanism is in the locked state and the unlocked state; and wherein the door is to mechanically and electrically decouple from the jointed assembly.

16. The housing of claim 15, wherein the door includes a connector that is positioned to electrically mate with a connector of the jointed assembly when the door is in either the open or closed positions.

* * * * *